US005185013A

United States Patent [19]

Martin

[11] Patent Number: 5,185,013

[45] Date of Patent: Feb. 9, 1993

[54] SYSTEM OF CRACK REPAIR FOR BUILDING AND PAVING MATERIAL

[76] Inventor: Robert A. Martin, 220 Nedra Dr., Barboursville, W. Va. 25504

[21] Appl. No.: 760,337

[22] Filed: Sep. 16, 1991

[51] Int. Cl.[5] ..... B32B 3/26

[52] U.S. Cl. ..... 52/514; 52/744; 404/75; 404/82; 156/94; 156/98

[58] Field of Search ..... 52/514, 743, 744; 404/75, 82; 156/94, 98, 71

[56] References Cited

U.S. PATENT DOCUMENTS 4,668,548 5/1987 Lankard ..... 52/514

*Primary Examiner*—David A. Scherbel
*Assistant Examiner*—Wynn E. Wood

[57] ABSTRACT

A method of crack repair for building and paving material which lowers an existing surface (S) to a new working surface (W) which is low enough to effect repairs without changing the elevation or attitude of the original surface: which fills the crack (C) with grout (1) which is in turn sealed by a bridging material (2). An initial overlay material (3) is placed over the bridging material and a reinforcing strip (4) embedded in the overlay material followed by a second layer of overlay material (5) sufficient to return the repaired area to the elevation and attitude of the original surface.

2 Claims, 2 Drawing Sheets

SYSTEM OF CRACK REPAIR FOR BUILDING AND PAVING MATERIAL

BACKGROUND

1. Field of Invention

This invention relates to repair of cracked building and paving material surfaces, specifically to surfaces for which functional or aesthetic restoration of the repaired surface is desired.

2. Description of the Prior Art

Cracked building and paving materials are commonly repaired for functional and/or aesthetic reasons, as well as to retard further deterioration.

Historically, cracked surfaces are cleaned and sealed using a variety of grout mixtures and other sealents or fillers in an attempt to prevent further deterioration, to prevent or reduce movement of the cracked area, and to restore continuity of the surface. However, such repairs are generally acknowledged to be temporary and require continuing maintenance and repair due to continuing movement of the crack with changing environmental conditions such as temperature and moisture fluctuations. This sequence of deterioration and repair commonly continues until the surface is no longer functional for its intended purpose and either an entirely new surface is applied or the old material removed and replaced.

Although a number of grout mixtures and processes have evolved, there has yet to be a system of crack repair which will withstand continuing movement of the crack while maintaining a smooth uncracked and functional surface. Existing techniques and methods simply do not produce a long lasting repair. Current repair methods do not prevent re-cracking of the surface because there is no provision to alleviate stresses induced as a result of continuing crack movement, or to strengthen materials above the crack. Repaired surfaces re-crack and become unsightly or nonfunctional because of tensile or compressional forces related to crack movement, and they do not produce surfaces suitable for many purposes, such as tennis court surfaces, where a smooth playing surface of uniform characteristic is mandatory.

Several alternatives to crack repair are also in common use. These include removal or partial removal of the original building or paving material and replacement with new material. This is an expensive and time consuming process. Another option is to overlay the existing surface with additional building or paving material, which is also a relatively expensive process and may not be practical in many situations where the elevation and orientation of the original surface must be maintained. It is also common for the overlay material to crack at the surface in the same locations as the original cracked building or paving material.

Although these various methods of crack repair are in extensive use, it is common knowledge that such repairs are either temporary, costly, or both. With the exception of complete removal and replacement of the building or paving material, existing crack repair products and methods suffer from a number of disadvantages:

(a) Grout mixtures placed within the crack are subject to the same deteriorating elements as the original material. Other than coating the surface with moisture resistant paint, there is no method to reduce this deterioration.

(b) The materials and methods currently used do not have any greater inherent tensile or compressive strength than the original building or paving material and thus are subject to recracking under the same stresses which created the original crack.

(c) If special coatings are required on the material surface, such as on recreational playing surfaces, the crack filling material may not adhere to the newly applied surface material, thus producing additional stresses on the surface and/or different surface characteristics, such as the way a tennis ball bounces upon impacting the repaired area.

(d) There is no mechanism to reduce surface and near surface stresses which created the original crack.

Objects and Advantages

Several objects and advantages of the invention described herein are:

(a) to provide a system of crack repair which can be used for a variety of building and paving surfaces without requiring the removal of the original material or changing the elevation or orientation of the surface;

(b) to provide a repair which will provide a smooth uncracked surface;

(c) to provide a repair which allows stresses originally creating the crack to be dispersed at or near the surface so that the probability of re-cracking is greatly reduced;

(d) to provide a repair which reduces surface movement;

(e) to provide a repair which will present a superior surface for special purpose finishes, such as those used on tennis court playing surfaces;

(f) to provide a repair which significantly reduces the potential for crack deterioration and renewed surface cracking;

(g) to provide a cost efficient repair method which will not require the same magnitude of maintenance and additional repair as existing methods require;

(h) to provide a repair which will allow the end user of the repaired surface to derive increased benefits from the repair—in other words, to provide a repair which can be warranted significantly in excess of any warranties or guarantees currently available.

Further objects and advantages are to provide contractors with a new repair method which can be installed easily and conveniently when compared to available alternatives, to provide repairs without damage to ancillary objects within and surrounding the area to be repaired (ie: no heavy equipment or major reconstruction techniques are required), and which can be completed in a relatively short period of time. Still further objects and advantages will become apparent from a consideration of the ensuing description and drawings.

DRAWING FIGURES

The two drawings furnished are closely related figures having the same number but different alphabetical suffixes.

Reference Letters In Drawings

Figure 1A:
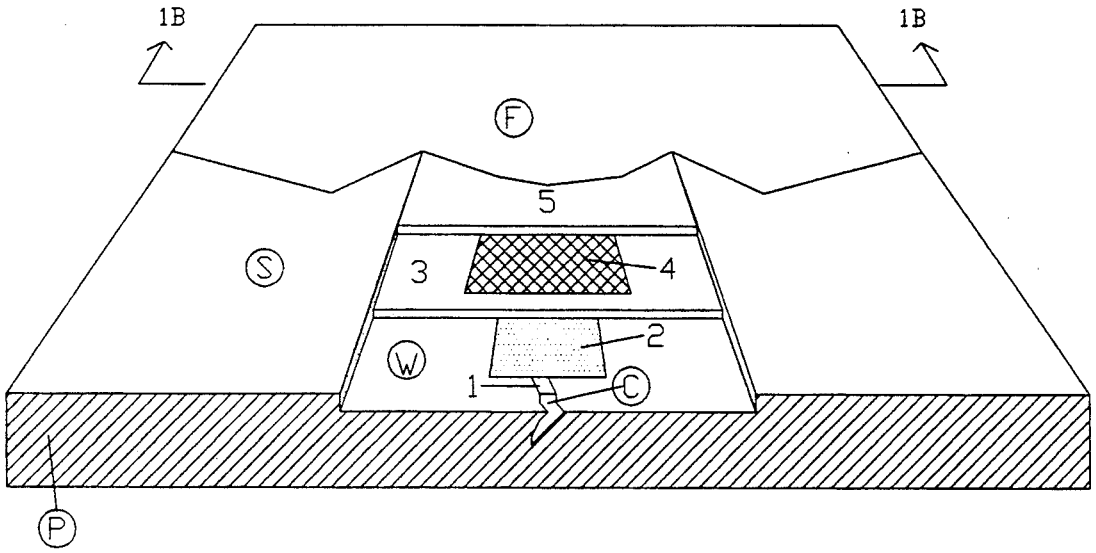
FIG. 1A shows a perspective view of a portion of the cracked building or paving material and the sequence of repairs and nature of repairs to be conducted.

P: Cross section of building or paving material
C: Existing crack in building or paving material
S: Original Surface
W: New working surface after partial removal of building or paving material
F: Finish coating Reference Numerals In Drawings 1. Grout material placed within crack.
2. Bridging tape.
3. First layer of overlay material.
4. Reinforcing strip.
5. Second layer of overlay material.

Figure 1B:
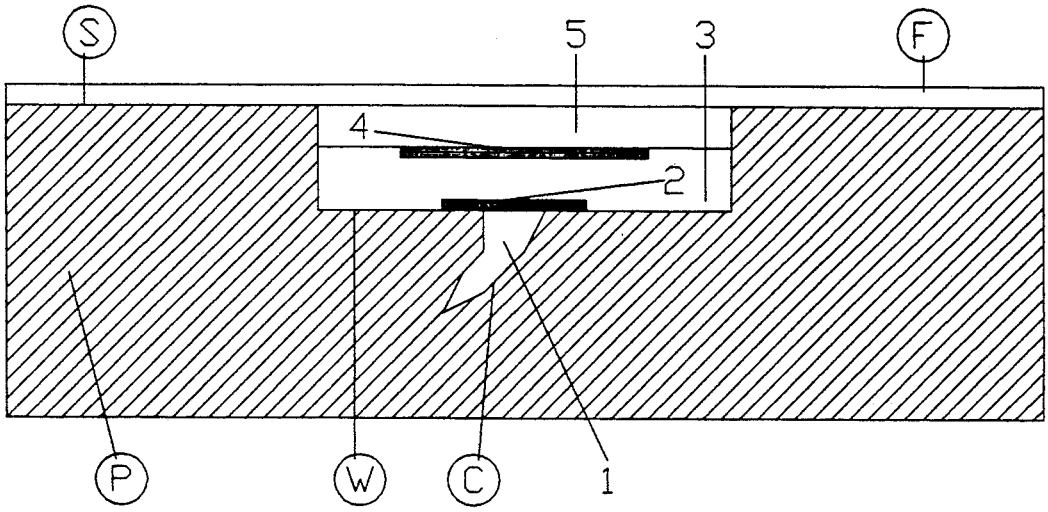
FIG. 1B shows a sectional view of the repaired area and the elements comprising the repair.

DESCRIPTION—FIGS. 1A and 1B

A typical embodiment of the repaired area, the sequence of repairs and the type of repairs are shown on FIG. 1A (perspective view) and FIG. 1B (sectional view). A building or paving material P may consist of any rigid to flexible building material, such as concrete or asphaltic substances, and may be of almost any thickness. A crack C to be repaired normally extends from the original surface to some depth within the building or paving material. To begin repair, an original surface S (which may or may not include a finish coating) is routed (ground down) to provide a new working surface W such that a sufficient thickness is available to allow repairs to be made without such repairs extending above the original surface. The crack is then cleaned out and filled with a crack filling mixture 1. The surface of the crack filling mixture is smoothed to approximately conform to the working surface. A bridging material 2 is then applied over the crack and onto the working surface. Although different types of bridging material may be used, in the preferred embodiment, the bridge material is a flexible reinforced tape with an adhering substance on one side which will stick to the working surface and the crack filling mixture, thus sealing the cracked area. The upper surface of the bridging tape must have characteristics which will prevent overlying material from bonding with the tape. An initial layer of overlay material 3 is then applied to the full length and width of the working surface in an amount sufficient to cover the bridging tape and to allow for the embedment of a reinforcing strip 4 within the overlay material. A second layer of overlay material 5 is then applied in an amount sufficient to cover the length and width of the routed area and in a thickness sufficient to completely cover the reinforcing strip and bring the new surface flush with the original surrounding surface. If desired, a final leveling and finishing coating material F may be applied for uniform appearance.

FIG. 1B is a sectional view through the repaired area and shows the same sequence of materials and steps as that shown on FIG. 1A. The vertical scale of FIG. 1B has been exaggerated somewhat in order to clearly show the relationship of the various elements of the crack repair system to the material being repaired. Note particularly the relationship of the reinforcing strip 4 to the initial layer of overlay material 3. The reinforcing strip is physically embedded in the overlay material.

From the description above, a number of advantages of this crack repair system become evident:

(a) the repair method can be instituted with a minimum of destructive damage or replacement of the original building or paving material.

(b) The repair method does not attempt to stop actual movement of the crack itself, but acts to minimize future deterioration of the crack.

(c) The repair method provides a non-adhering bridge between the crack and new materials overlying the crack so that stress within these materials is reduced.

(d) The repair method provides a reinforced zone of material above the crack to add strength to the repair system and to further prohibit recracking.

(e) The repair method provides a new uncracked and strong surface which can be left as is or overlain with one of several types of finish coatings, such as acrylic finish, for aesthetic purposes or for uniform functional purposes.

(f) The repair method can be implemented without the use of heavy construction equipment or other construction methods requiring extensive pathways for ingress and egress of equipment.

Operation—FIGS. 1A and 1B

The manner in Which this crack repair system is implemented is unique in several instances and is described in sequential steps as follows:

The area of the building or paving material P to be repaired is first routed to a depth beneath the original surface S sufficient to allow installation of the repair materials without such materials extending above the original surface. The grinding process and equipment used for the process may vary depending upon the type of building or paving material and access, but typically consists of a mechanical grinder capable of removing the old material to the depth required and in a fashion so as to keep the crack C in the approximate center of the routed area. Depending upon the size of the crack, the nature and characteristics of the building or paving material, and the length and accessibility of the crack, the grinding method may vary. Typically, grinding is accomplished with a hand operated gasoline powered grinder capable of routing the building or paving material to the required depth and to a width which has been determined to be satisfactory for the installation and satisfactory performance of the repair system. For example, for a cracked tennis court recreational surface, a typical procedure would involve using a machine to route existing coatings and paving material to a depth of approximately one sixteenth of an inch and eight to ten inches wide over, and along the length of, the crack and extending approximately two to three feet beyond the ends of the crack.

Following the routing procedure, the crack is then cleaned of loose or foreign material and filled with a crack filling mixture 1 which typically consists of a grout type of mixture of a consistency which will allow filling of the crack and smoothing to the new working surface W. The crack filling material subsequently hardens, reducing the potential for further deterioration of the crack and providing resistance to unrestricted lateral movement of the building or paving material adjacent to the crack.

After the crack filling mixture has hardened, a flexible bridging tape 2 is applied to the full length of the crack. Different types of bridging material may be used, but material with characteristics similar to duct tape has been found satisfactory. The bridging tape should have a lower surface which will adhere to the crack filling mixture and original building or paving material, and should have a smooth non-adhesive and non-bonding upper surface. The bridging tape should be wide enough so that its edges extend beyond the edges of the crack for a distance sufficient to substantially reduce crack movement induced stresses on overlying materials.

After the bridging tape has been applied, an initial layer of overlay material 3 is applied the full length and width of the routed area and a flexible reinforcing material 4 embedded in the overlayment. Typically, the overlay material is of a consistency which will allow it to be roller applied and which will harden after the reinforcing strip has been applied. The reinforcing strip will typically consist of a fibrous material of sufficient strength to further reduce any stresses or other influences from underlying crack movement and sufficient to prevent such movement from re-cracking the new surface.

After embedment of reinforced material and hardening of the initial overlay material, a second overlay coat 5 is applied in the same fashion as the initial overlay coat. The second overlay application is made such that the new surface is flush with the original surface.

The new surface is sanded, if necessary, and an etching liquid applied to prevent possible discoloration of finish coat materials F.

Summary, Ramifications, and Scope

The reader can see that the crack repair system can be used on a wide variety of cracked building or paving material surfaces, can be easily installed without damaging adjacent construction elements or landscaping, and can be used to prevent surface re-cracking without requiring extensive replacement or additions to the building or paving material. In addition, this repair system will provide a smooth uncracked surface, reduces surface movement, and is particularly adaptable for repairing and resurfacing special purpose building and paving materials, such as recreational playing surfaces. Further more, the crack repair system has additional advantages in that

* it produces a repair with substantially longer functional use than other repair methods;
* it provides a cost efficient repair method which will not require the same magnitude of maintenance and additional repair as existing methods;
* it provides a mechanism which allows stresses to be disbursed so that the probability of re-cracking is greatly reduced and overall subsurface crack movement is inhibited;
* repairs can be effected in a relatively short period of time.

Although the description above contains many specificities, these should not be construed as limiting the scope of the invention but as merely providing illustrations of some of the presently preferred embodiments of this invention. For example, the method of repair can be accomplished on a wide variety of building, pavement or other surfacing and/or structural materials, the routed depth and width can be substantially altered as needed, and a number of different types of crack filler, bridging material, overlay material and reinforcing material may be used, etc.

Thus the scope of this system of crack repair should be determined by the appended claims and their legal equivalents, rather than by the examples given.

I claim:

1. The method of crack repair for building and paving material, comprising the steps of:

a. lowering the original surface in the area surrounding the crack to a depth sufficient to effect repair of the surface without changing the elevation or attitude of the original surface, and b cleaning and filling said crack with a crack filling material, and c. applying a flexible fabric bridging material containing an adhesive which adheres to said crack filling material and said existing building or paving material and which has a glazed upper surface with a low coeffecient of friction which discourages bonding with additional repair materials which will be placed above said bridging material, and d. application of an initial overlay material over said bridging materail, and e. embedment of a reinforcement material within said initial overlay material, and f. application of a second layer of overlay material over said initial overlay natural in an amount sufficient to bring the new surface flush with said original surrounding surface.

2. The method of crack repair of claim 1 for building and paving material consisting of:

a. a sequence of constructed elements which will reduce surface and near-surface stress to the point where re-cracking of said surface is prohibited, and b. effecting repairs without altering the elevation or attitude of said original surface.

* * * * *